United States Patent [19]

Runkle

[11] 4,285,176

[45] Aug. 25, 1981

[54] SHELTER TRUSS

[76] Inventor: Paul S. Runkle, 323 - 90th Ave. West, Duluth, Minn. 55806

[21] Appl. No.: 63,788

[22] Filed: Aug. 6, 1979

[51] Int. Cl.[3] ..... E04B 7/02

[52] U.S. Cl. ..... 52/93; 52/79.7; 52/234; 52/648

[58] Field of Search ..... 52/90, 93, 79.7, 234, 52/236.7, 586, 646, 648, 650, 71, 236.1

[56] References Cited

U.S. PATENT DOCUMENTS

| | | | |
|---|---|---|---|
| 1,421,299 | 6/1922 | Palen | 52/93 |
| 1,837,374 | 12/1931 | Samuel . | |
| 1,849,273 | 3/1932 | Broderick . | |
| 2,365,579 | 12/1944 | Mulligan | 52/586 |
| 3,008,195 | 11/1961 | Coffey | 52/650 |
| 3,206,903 | 9/1965 | Johnson | 52/93 |
| 3,791,082 | 2/1974 | Bowling | 52/726 |
| 3,913,285 | 10/1975 | Helfrich | 52/648 |
| 3,965,626 | 6/1976 | Johnson | 52/648 |
| 3,983,665 | 10/1976 | Burton | 52/71 |
| 4,078,341 | 3/1978 | Peterson et al. | 52/71 |

FOREIGN PATENT DOCUMENTS

| | | | |
|---|---|---|---|
| 148469 | 10/1952 | Australia | 52/79.7 |
| 153557 | 10/1953 | Australia | 52/93 |
| 226059 | 6/1958 | Australia | 52/234 |
| 488666 | 12/1952 | Canada | 52/90 |
| 375184 | 5/1923 | Fed. Rep. of Germany | 52/90 |
| 151604 | 12/1921 | United Kingdom | 52/648 |

*Primary Examiner*—James L. Ridgill, Jr.

*Attorney, Agent, or Firm*—Schroeder, Siegfried, Ryan, Vidas, Steffey & Arrett

[57] ABSTRACT

A shelter truss comprising a unitary trapezoidal skeletal component, a plurality of which when connected forms a completely framed superstructure of a building, ready to accept exterior covering, wiring, plumbing, insulation, flooring, interior walls, ceilings and the like. No additional structural framework is required, except interior room division. The building shape in a vertical plane is complete when the component is erected.

14 Claims, 7 Drawing Figures

SHELTER TRUSS

This invention relates to a shelter truss but more specifically, it relates to a simple unitary truss, a number of which can be simply joined to comprise a completely framed superstructure of a building.

It is a general object of my invention to provide a novel and improved simple truss which defines the vertical shape of the building and, when joined together with similar trusses, forms a completely framed superstructure of a building, ready to accept exterior covering, wiring, plumbing, insulation, flooring, interior walls, ceilings, and the like.

Another object is to provide a novel and improved shelter truss which is simple and inexpensive to construct, assemble, and utilize in order to provide the complete superstructure of the building when interconnected in plural numbers.

Another object is to provide a novel and improved shelter truss which enables the builder to assemble a superstructure with a minimum of effort and expense by merely connecting a plurality of such trusses to thereby provide a completed framework for the building desired, with two floor levels, and ready to receive flooring, roofing, insulation, interior walls, ceilings, etc.

Another object is to provide a novel shelter truss component which when erected determines and completes the shape of the building to be constructed therefrom in one vertical plane.

Another object is to provide a novel shelter truss which, when utilized, makes it easier, less expensive, and more simple to construct a desired building, is readily transportable in building component form, and has unusual design capabilities and flexibility of use.

These and other objects and advantages of the invention will more fully appear from the following description, made in connection with the accompanying drawings, wherein like reference characters refer to the same or similar parts throughout the several views, and in which.

Figure 1:
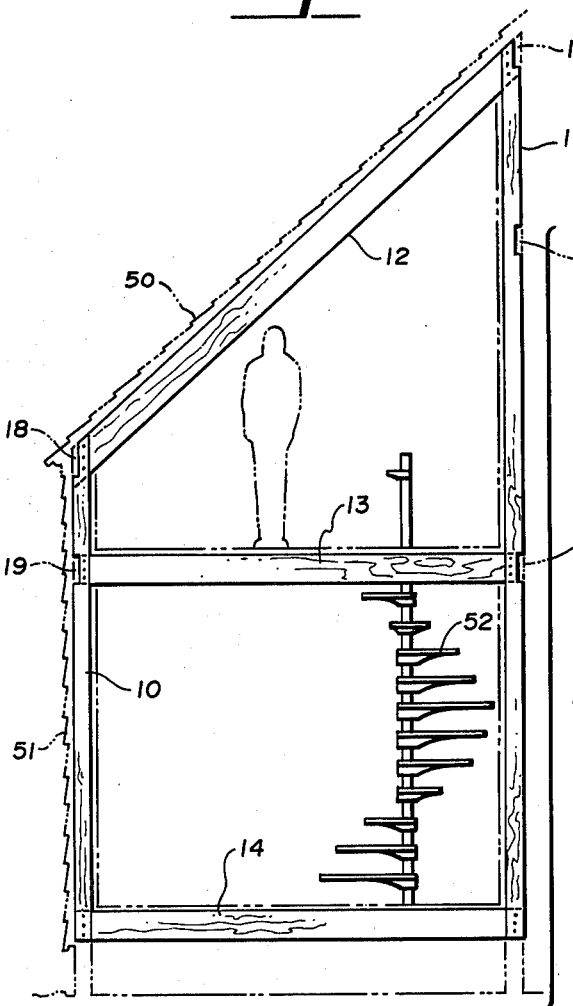
FIG. 1 is an end elevational view of a shelter constructed from a plurality of my trusses.

As shown, the basic element of my invention is a shelter truss component which is trapezoidal in shape and is comprised of only four or five members, including a pair of upright members 10, 11, the latter of which is longer as shown in FIG. 1. The two upright members 10, 11 are connected at their upper ends by a roof rafter 12 and at their lower intermediate portions by a joist 13. If desired, a floor joist 14 extending between the lower ends of the upright members 10, 11 may be provided.

When a plurality of these components are arranged in spaced parallel relation, they are interconnected with tie plates 15–19, as shown, to comprise a unitary structural skeleton for a building which defines the entire shape of the building.

Figure 2:
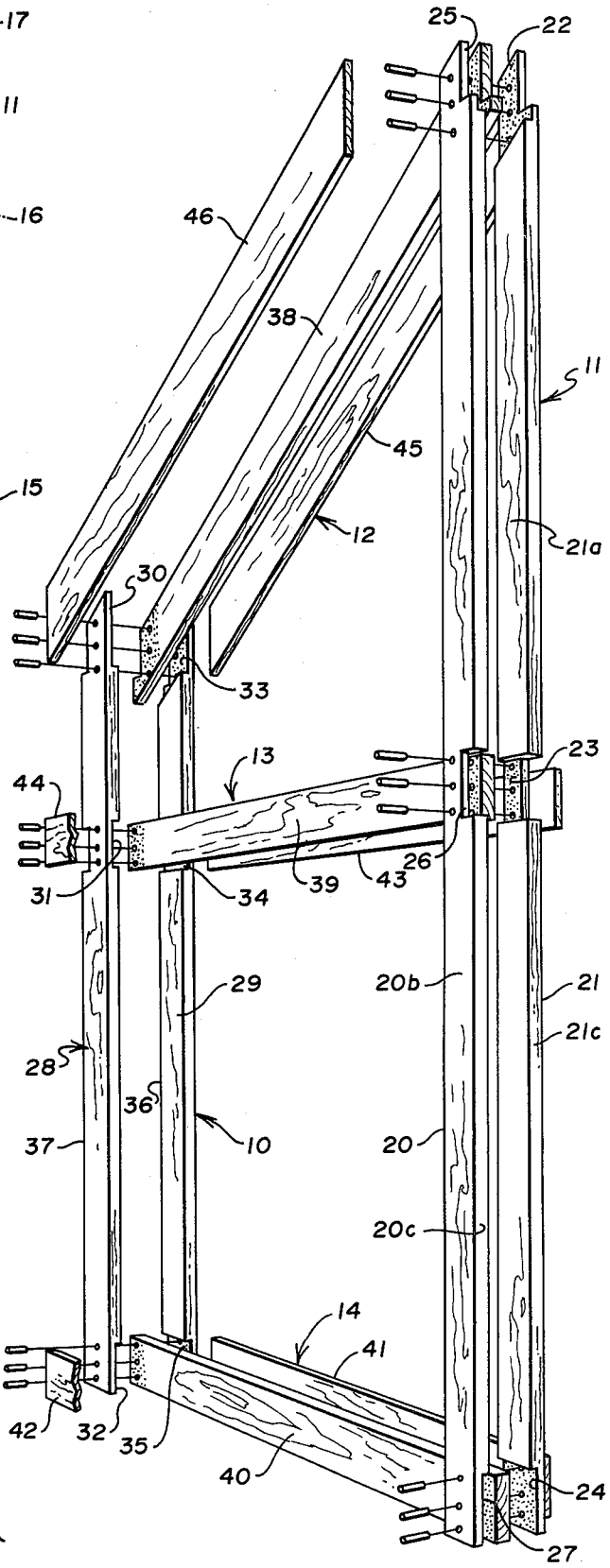
FIG. 2 is an exploded perspective view of one of such trusses.

As shown in FIG. 2, the longer upright member 11 is comprised of a pair of laminates 20, 21 which have opposed inner surfaces such as indicated as 21*a* facing and glued to each other throughout their entire lengths. Each has an outer surface such as indicated by 20*b* and outer edge portions as indicated by 20*c*, 21*c*.

The inner surface of the laminate 21 is relieved at its upper end as at 22, at its intermediate portion as at 23 and at its lower end as at 24. The inner surface of the laminate 20 is recessed at its upper end as at 25, at its intermediate portion at 26, and at its lower end as at 27. These recesses are provided to accommodate a rafter or joist as will be hereinafter described.

The upright member 11 is preferably formed of wooden laminates 20, 21 which are 24 feet long and 2"×6"in cross-section.

The shorter upright member 10 is similarly formed of a pair of wooden laminates 28, 29 of similar cross-sectional dimensions and approximately 13 feet in length. The laminate 28 has its inner surface recessed at its upper end as at 30, at its intermediate portion as at 31, and at its lower end as at 32. Likewise, laminate 29 has its inner surface relieved at its upper end as at 33, at its intermediate portion as at 34, and at its lower end as at 35. It also has outer edge portions as indicated by the numeral 36. The laminate 28 has corresponding outer edge portions 37.

In forming one of my trusses, the laminates 21 and 29 are placed in spaced parallel arrangement with their inner surfaces facing upwardly. Glue is then applied to their inner surfaces throughout their entire length. Glue is then applied to the end portions of a roof rafter member 38, to the end portions of the joist member 39, and if desired, to the end portions of a floor joist member 40. The roof rafter member 38 is preferably 16.5' long while the joist members 39 and 40 are preferably 12' long. Each of these members are wooden and preferably 2"×10" in cross-section. These members are then placed in the recessed portions, as shown in FIGS. 1 and 2, of the upright members and the laminates 20 and 28 are then applied thereto after having had their inner surfaces coated with glue. They are then clamped in position and doweled as shown in FIG. 2 at each point of juncture of the rafter and joists with the two upright members.

Figure 6:
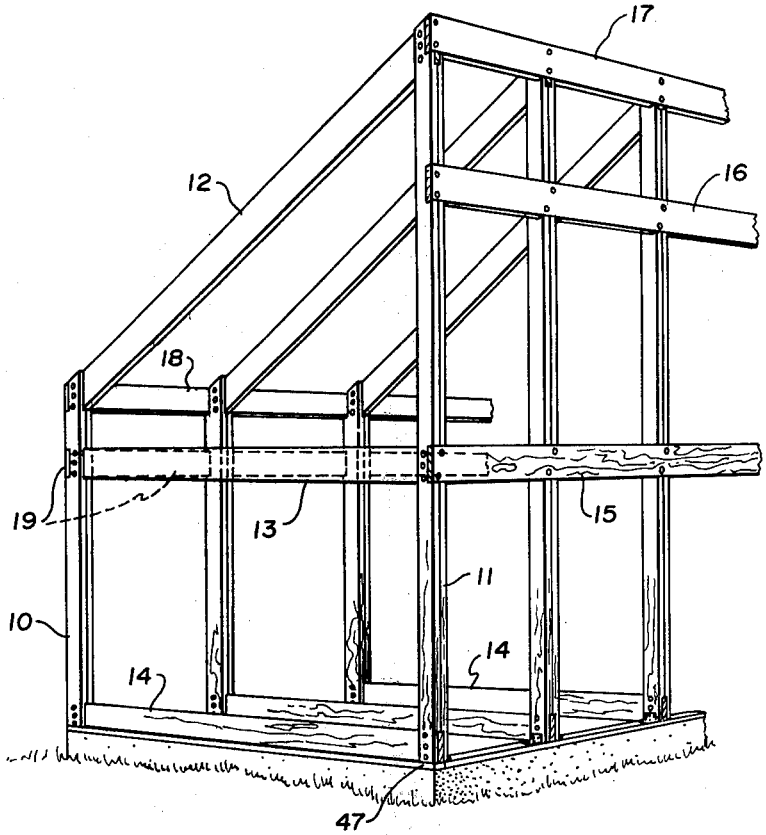
FIG. 6 is a partial perspective view of a structural skeleton constructed from a plurality of my trusses.

Once the glue of the skeletal unit described above has adequately dried, the outer edge portions of each of the upright members 10 and 11 are routed out at their upper ends and at their intermediate portions directly opposite the joist 39. This can be readily seen in FIGS. 1 and 2 and is intended to accommodate the tie members 15–19 as best shown in FIGS. 1, 2 and 6 whereby a plurality of the individual trusses may be rigidly secured together to comprise a shelter skeleton as shown in FIG. 6. The tie members 15–19 are each preferably 2"×10" in cross-section.

Prior to assembling a plurality of the individual skeletal components as shown in FIG. 6, they may be substantially strengthened, if desired, by applying glue to the ends and inner sides of the spar members and gluing them to the sides of the raft member 38, the joist member 39, and the floor joist member 40. Thus spar members 41, 42 are cut of such a length as to fit snugly between uprights 10 and 11 and are of such cross-sectional dimensions as to be of the same height as the member 40 and to extend flush with the exterior surfaces of the laminates 20, 21 and 28, 29.

Similarly, spars 43, 44 extend between and abut against the upright members 10 and 11 and are glued throughout their length to the exterior of joist member 39 and have cross-sectional dimensions such that they extend flush with the laminates and their vertical dimensions coincide with those of joist member 39.

Also similarly, spar members 45, 46 extend between and abut against the laminates of the upright members 10, 11 and are glued throughout their length to the sides of roof rafter member 38 and have cross-sectional dimensions such that they extend flush with the laminates of the members 10, 11 and their vertical dimensions coincide with those of roof rafter member 38.

Figure 3:
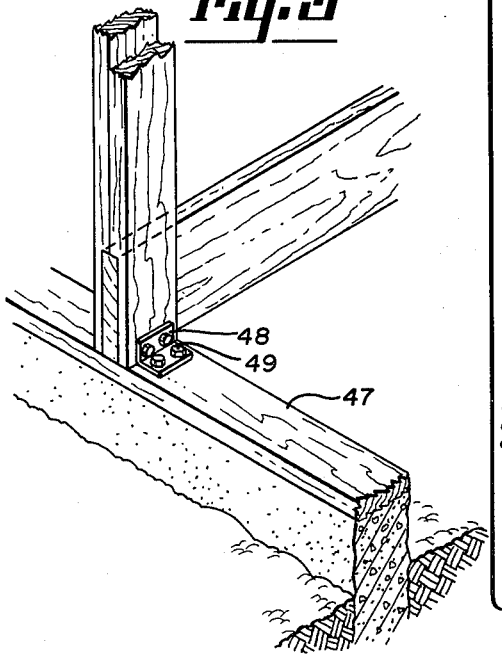
FIG. 3 is a fragmentary perspective view illustrating the manner in which one of my trusses is secured to a sill.

In assembling a skeletal form for a shelter from my trusses, the individual trapezoidal components are placed preferably either on 2 or 4 foot centers in parallel relation and are secured at their lower ends to a sill 47 as shown in FIG. 3 by means of metal fasteners 48 and bolts 49 with one each of such fasteners at each side of the upright member. When the tie plates 15–19 are applied and properly secured in the recesses provided therefore in the outer edge portions of the upright members, a very rigid and adequate skeletal framework is provided.

One advantage of this shelter truss is that it is unique in that the shape of the building is predetermined and complete as soon as a single component is erected. This is in contrast to the heretofor commonly used trusses in which only a portion of the building is created by putting such a truss in place. It will be noted that as soon as a plurality of my components are assembled, as described, a completely framed superstructure has been provided. Moreover that superstructure is ready to accept exterior coverings (side walls), roofing, wiring, flooring, room walls, plumbing, insulation, and all other elements of a completed building. No additional structural work is required, excepting interior room division, if and when desired.

It will be noted that once a number of such components are interconnected, as described, that the floor joists, if utilized, provide a sound supporting structure for and is ready to receive flooring. At the same time, the joist 13 provides support for the second room flooring and the lower room ceiling, if desired. Likewise, the roofing rafter 12 provides ample support for roofing, such as indicated by the numeral 50. The shorter upright 10 likewise provides ample support for siding as indicated by the numeral 51. If desired, a spiral or other stairway 52 as shown in FIG. 1 may be constructed between two adjacent components to provide access to the second story level.

Figure 4:
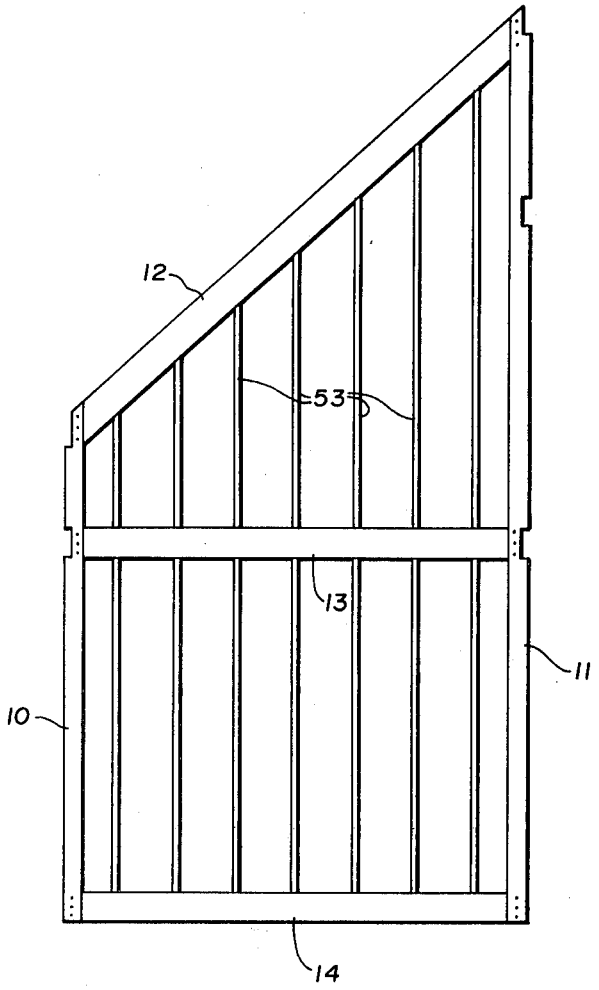
FIG. 4 is an end elevational view showing one of my trusses with studs in place, preparatory to applying an end wall thereto.
Figure 5:
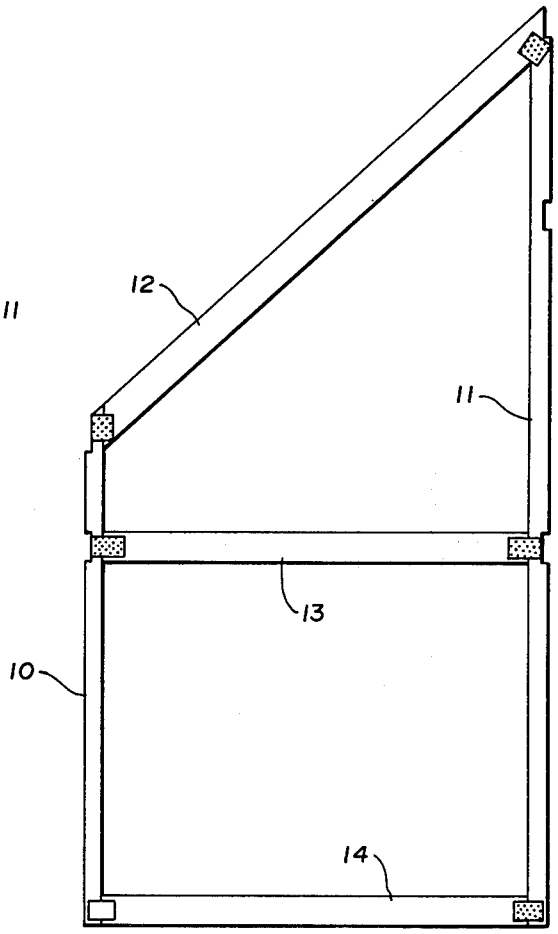
FIG. 5 is an end elevational view of one of my trusses showing a single truss in its most simple assembled form.
Figure 7:
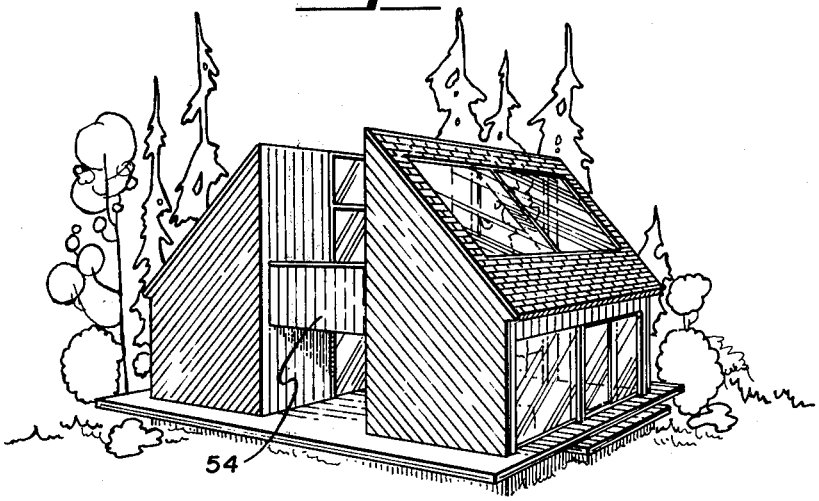
FIG. 7 is a pictorial view showing how two spaced shelters constructed from my trusses may be utilized as living quarters in interconnected relation.

FIG. 4 illustrates how studs 53 may be supported by the roof rafter and joists of the end component to provide for the application and support of end walls or siding. FIG. 7 illustrates the adaptability of my shelter truss for use in the construction of simple, inexpensive but attractive living units which may be interconnected by a second level passageway 54.

The flexibility of use, its varied design capabilities, and speed and ease of its erection, and its ready and convenient transportability makes this truss a highly desirable and valuable construction unit. It may be utilized in the construction of year around homes or for non-insulated low-cost summer homes, or for simple shelters desired for other purposes. A plurality of such components may be readily covered with translucent fiberglas for greenhouse purposes or they may be readily adapted for use in the construction of a solar heated home. It is relatively inexpensive and simple to construct and erect and offers many advantages, as outlined above, not heretofor available.

It will, of course, be understood that various changes may be made in the form, details, arrangement and portions of the parts without departing from the scope of the invention which consists of the matter shown and described herein and set forth in the appended claims.

What is claimed is:

1. A unitary structural skeleton for a building which defines the entire shape of that building consisting in:

(a) a plurality of upright trapezoidal shelter trusses of the same dimensions and constructed and arranged in spaced parallel relation, each of said trusses comprising:

(1) a pair of spaced parallel rigid upright members of different lengths, each having upper and lower end portions, intermediate portions, and outer edge portions;

(2) each of said upright members being comprised of a pair of elongated laminates having inner and outer surfaces and being of equal widths at their upper and lower ends;

(3) said inner surfaces of each of said laminates being recessed at each of the upper ends of said laminates to accommodate a rafter therebetween;

(4) a rafter extending between said members and being glued at each of its ends within said recesses and to said laminates and extending flush with the ends of said laminates;

(5) said inner surfaces of each of said laminates also being recessed in juxtaposed position at a point intermediate the ends of said members to accommodate a joist therebetween;

(6) a joist extending horizontally between said members and being glued at each of its ends within said second mentioned recesses and to said laminates;

(7) each of said pairs of said laminates having their outer edge portions recessed at their upper ends and directly opposite the associated end of said rafter to accommodate and receive a horizontal tie member therein in order to tie said shelter truss to other and similar shelter trusses;

(8) the ends of said rafter being flush with its said associated recessed surfaces of said laminates;

(9) each of said pairs of laminates having their inner surfaces glued only to each other and having only their outer edge portions recessed at a point opposite the ends of said joist to accommodate and receive a horizontal tie member therein in order to tie said shelter truss to other and similar shelter trusses;

(10) the ends of said joist being flush with its said associated recessed surfaces of said laminates;

(b) a pair of horizontal tie plates, one each of which is connected to and positioned within the corresponding recessed edge portions of said upper ends of each of said pairs of laminates and extending flush with said edge portions and tieing said shelter trusses together; and (c) a second pair of horizontal tie plates, one each of which is positioned within and connected to the corresponding recessed portions of each of said pairs of laminates opposite the ends of said joists and extending flush with said edge portions of said laminates and cooperatively tieing said shelter trusses together into a structural skeleton.

2. The structure defined in claim 1 wherein the juxtaposed inner surfaces of each of said pairs of laminates are recessed at their lower end portions to accommodate and receive a floor joist therein, and a floor joist extending horizontally between said pair of said members and being glued at each of its ends within said third mentioned recesses and to said laminates, the ends of said floor joist being flush with the outer edge portions of said laminates.

3. The structure defined in claim 1 wherein the outer edge portions of the pair of laminates of the longer of said uprights in each of said shelter trusses are recessed at a point between said rafter and said first mentioned joist to accommodate and receive a horizontal tie plate therein, and a horizontal tie plate extending between said upright members and being secured within said last mentioned recesses and to said upright members to tie said shelter trusses together.

4. A structural skeletal component for a building which defines the entire shape of that building in one vertical plane, consisting in a trapezoidal shelter truss comprising:

(a) a pair of spaced parallel rigid upright members of different lengths, each having upper and lower end portions, intermediate portions, and outer edge portions;

(b) each of said upright members being comprised of a pair of elongated laminates having inner and outer surfaces and being of equal widths at their upper and lower ends;

(c) said inner surfaces of each of said laminates being glued directly to each other throughout substantially its entire length and being recessed at each of the upper ends of said laminates to accommodate a rafter therebetween;

(d) a rafter extending between said members and being glued at each of its ends within said recesses and to said laminates;

(e) said inner surfaces of each of said laminates being glued to each other and also being recessed in juxtaposed position at a point intermediate the ends of said members to accommodate a joist therebetween; and (f) a joist extending horizontally between said members and being glued at each of its ends within said second mentioned recesses and to said laminates.

5. The structure defined in claim 4 wherein each of said laminates is glued to the other associated laminate of that pair throughout substantially their entire lengths.

6. The structure defined in claim 4 wherein each pair of said laminates has its outer edge portions recessed at a point opposite its associated end of said joist and the ends of said joist are flush with the said recessed surfaces of said laminates at their juncture.

7. The structure defined in claim 4 wherein said inner surfaces of each of said laminates is recessed at each of the lower ends of said laminates to accommodate a floor joist therebetween; and (g) a floor joist extending horizontally between said members and being glued at each of its ends within said last mentioned recesses and to said laminates.

8. The structure defined in claim 7 wherein the ends of said last mentioned joist are flush with the outer edge portions of said laminates.

9. The structure defined in claim 7 and dowels extending through said rafter and said joists and said pairs of laminates at each of their points of juncture.

10. The structure defined in claim 4 wherein each pair of said laminates have their outer edge portions recessed at their upper ends directly opposite the associated end of said rafter to accommodate and receive a horizontal tie member therein in order to tie said shelter truss to a second and similar shelter truss.

11. The structure defined in claim 10 wherein the laminates of the longer of said two upright members have the outer edge portions thereof recessed at a point intermediate their upper ends and said first mentioned joist to accommodate and receive a second horizontal tie member therein in order to further tie said shelter truss to such a second and similar shelter truss.

12. A component of trapezoidal design which defines the overall shape of a building when viewed from its face plane and encompasses all structural requirements therein, a plurality of which when connected together create a structure containing two floors of unrestricted passage on the horizontal planes, said component comprising:

(a) a pair of spaced parallel rigid upright members of different lengths, each having upper and lower end portions, intermediate portions and outer edge portions;

(b) each of said upright members being comprised of a pair of elongated laminates having inner and outer surfaces and being of equal widths at their upper and lower ends;

(c) said inner surfaces of each of said pairs of laminates being glued directly to each other throughout substantially its entire length and being recessed to accommodate a rafter therebetween;

(d) a roof rafter extending between said members and being glued at each of its ends within said recesses to said laminates;

(e) said inner surfaces of each of said laminates also being recessed in juxtaposed position at a point intermediate the ends of said members to accommodate a joist therebetween;

(f) a joist extending horizontally between said members and being glued at each of its ends within said second mentioned recesses and to said laminates;

(g) a pair of span members extending between said upright members and along opposite sides of said rafter, each of said span members having substantially the same vertical dimensions as said rafter and being glued along substantially its entire length to one side thereof and having transverse dimensions such that it extends flush with its associated corresponding outer surface of said laminates; and (h) a second pair of span members extending between said upright members and along opposite sides of said joist, each of said second span members having substantially the same vertical dimensions as said joist and being glued along substantially its entire length to one side thereof and having transverse dimensions such that it extends flush with its associated corresponding outer surface of said laminates.

13. The structure defined in claim 12, (i) said inner surfaces of each of said laminates being recessed at each of the lower ends of said laminates to accommodate a floor joist therebetween;

(j) a floor joist extending between said members and being glued at each of its ends within said last mentioned recesses and to said laminates; and (k) a third pair of span members extending between said upright members and along opposite sides of said floor joist, each of said third pair of span members having substantially the same vertical dimensions as said floor joist and being glued along substantially the entire length to one side thereof and having transverse dimensions such that it extends flush with its associated correponding outer surface of said laminates.

14. A structural skeletal component for a building which defines the entire shape of the building in one vertical plane consisting of a shelter truss comprising:

(a) a pair of spaced rigid upright members, each having upper and lower end portions, intermediate portions, and outer edge portions;

(b) each of said upright members being comprised of a pair of elongated laminates having inner and outer surfaces;

(c) said inner surface of each of said laminates being glued to each other along substantially its entire length and being recessed at each of the upper ends of said laminates to accommodate a rafter therebetween;

(d) a rafter extending between said members and being glued at each of its ends within said recesses and to said laminates in snug-fitting flush relation;

(e) said inner surfaces of each of said laminates being glued to each other and also being recessed in juxtaposed position at a point intermediate the ends of said members to accommodate a joist therebetween; and (f) a joist extending horizontally between said members and being glued at each of its ends within said second mentioned recesses and to said laminates in snug-fitting flush relation.

* * * * *

UNITED STATES PATENT AND TRADEMARK OFFICE

CERTIFICATE OF CORRECTION

PATENT NO. : 4,285,176

DATED : August 25, 1981

INVENTOR(S) : Paul S. Runkle

It is certified that error appears in the above-identified patent and that said Letters Patent are hereby corrected as shown below:

Column 4, line 53, delete "only" and insert --directly-- therefor.

Column 8, line 5, after "glued" insert --directly--.

Signed and Sealed this

Tenth Day of November 1981

[SEAL]

Attest:

GERALD J. MOSSINGHOFF

Attesting Officer

Commissioner of Patents and Trademarks